United States Patent [19]

Malik

[11] 4,145,467

[45] Mar. 20, 1979

[54] WOVEN TEXTILE

[75] Inventor: Kuldip R. Malik, Waynesboro, Va.

[73] Assignee: Thiokol Corporation, Newtown, Pa.

[21] Appl. No.: 843,099

[22] Filed: Oct. 17, 1977

Related U.S. Application Data

[63] Continuation of Ser. No. 583,001, Jun. 6, 1975, abandoned, which is a continuation-in-part of Ser. No. 493,185, Jul. 30, 1974, abandoned.

[51] Int. Cl.[2] ..... B32B 5/16

[52] U.S. Cl. ..... 428/91; 26/29 R; 428/95

[58] Field of Search ..... 428/91, 95; 26/29 R

[56] References Cited

U.S. PATENT DOCUMENTS

| | | | |
|---|---|---|---|
| 3,542,632 | 11/1970 | Eickhoff | 428/95 |
| 3,549,470 | 12/1970 | Greenwald | 428/95 |

*Primary Examiner*—Marion E. McCamish

*Attorney, Agent, or Firm*—Stanley A. Marcus; Thomas W. Brennan

[57] ABSTRACT

A woven synthetic textile, useful as the primary and secondary backing for carpets and as woven cloth to manufacture bags, bale wrap, wall covering, drapes and the like, can be prepared using a heavily fibrillated synthetic ribbon as at least one of the warp and fill members. The textile is characterized by the look and feel of a jute fabric. The fabric may be further treated after weaving to lift the fibril ends above the fabric surface as by brushing and/or needling.

52 Claims, No Drawings

WOVEN TEXTILE

This is a continuation of application Ser. No. 583,001 filed June 6, 1975, now abandoned, which in turn was a continuation-in-part of copending application Ser. No. 493,185 filed July 30, 1974, now abandoned.

BACKGROUND OF THE INVENTION

1. Field

This invention relates generally to woven textile fabrics made from synthetic materials. The fabrics are useful to replace burlap, jute and other natural fiber textiles in the manufacture of primary and secondary backings and in the production of sacks, bags, bale wrap, wall covering, drapery and the like.

2. Description of Prior Art

In the carpet manufacturing area of the textile arts, several patents have issued illustrating the attempts of prior artisans to provide a fabric which may be useful for synthetic primary and secondary backings for the carpets.

U.S. Pat. No. 3,542,632, filed Feb. 28, 1969, issued Nov. 22, 1970 to H. L. Eickhoff discloses that a synthetic primary or secondary backing can be prepared by weaving the fabric using polyolefin ribbons as both warp and fill, and thereafter lightly or severely fibrillating the entire fabric. While the resulting, severely fibrillated material does have acceptable adhesion when used as a secondary backing it has virtually no strength. Example 8 below illustrates the results obtained by following the instructions of Eickhoff.

U.S. Pat. No. 3,283,788, filed Apr. 7, 1964, issued Nov. 8, 1966 to A. Bottomley, et al., discloses a method for weaving thermoplastic fabrics wherein a highly oriented sheet of thermoplastic material is disintegrated by mechanical treatment such as striking, rubbing, brushing and vibrating it to a web of split fibers which is passed over multiple U-shaped fingers that push upwardly through the sheet to form a warp shed. Fill yarns are passed through the shed to form a woven structure. The products of Bottomley et al., if used as secondary carpet backings, have unknown adhesive quality, and due to the mechanical working of the fabric to form the warp would have questionable strength characteristics, particularly in the direction of the warp. In addition, the use of costly split-fiber sheet material would result in an expensive product.

U.S. Pat. No. 3,549,470, filed Jan. 3, 1967, issued Dec. 22, 1970 to E. F. Greenwald et al., discloses an olefinic primary or secondary backing fabric woven from foamed, hot melt attenuated fabrilliated olefin yarns in the warp and/or fill. The adhesion characteristics of the fabric are not considered and the fabric strength is not evaluated.

U.S. Pat. No. 3,317,366, filed May 18, 1962, issued May 2, 1967 to V. J. Dionne discloses a primary backing fabric woven of polyester ribbons in the warp and spun polyester yarn in the fill. The polyester material is quite expensive and no mention is made of strength or adhesive qualities. Further, no fabrillated material is disclosed, therefore, a secondary backing fabric having acceptable adhesion when laminated to a primary backed face pile is neither considered nor contemplated by the patentee.

SUMMARY OF THE INVENTION

In its broadest aspect, this invention relates to a woven fabric having a synthetic warp and fill members, at least one of the members being heavily fibrillated. In another aspect, this invention relates to a synthetic woven carpet backing fabric having synthetic warp and fill members, at least one of the members being heavily fabrillated. In still another aspect, this invention relates to a synthetic woven fabric, useful as a backing in a carpet fabric or the like, having as one of its warp and fill members a substantially unfibrillated or an unfibrillated ribbon and a heavily fabrillated ribbon as the other member. In yet another aspect, this invention relates to a synthetic primary or secondary backing for carpets and the like, comprising polyolefin ribbon as the warp or fill member, heavily fibrillated polyolefin ribbon as the other member, characterized by a delamination strength greater than 7.5 pounds when laminated to a faced fabric structure such as a soft carpet fabric. In yet still another aspect, this invention relates to a carpet structure comprising a ground member or primary backing, face materials such as a face pile secured to the ground member and a woven secondary backing laminated to the faced ground member, the secondary backing comprising polyolefin ribbon as the warp or fill component and heavily fabrillated polyolefin ribbon as the fill or warp component, the delamination strength of the secondary backing being in excess of 7.5 pounds, the tensile strength of the fabric in the heavily fabrillated member direction being in excess of 25 pounds and of the other member being in excess of 30 pounds.

In another aspect, this invention relates to a method of making a synthetic fabric useful as a primary or secondary carpet backing comprising weaving synthetic ribbon warp or fill members and a heavily fabrillated fill or warp member into the fabric described above and treating the fabric by brushing and/or needling to raise the ends of the fibrils of the fabrillated warp or fill above the surface of the fabric and thereafter laminating it to a pile fabric as above described for its use as a secondary backing.

DESCRIPTION OF THE INVENTION

In the manufacture of quality pile fabrics such as carpets and the like, a face is secured to a fabric which can be denominated the ground member or primary backing as by weaving, tufting or needle-punching a staple fiber thereinto. An adhesive, often rubber latex, or the so called hot melt adhesives, is then applied to the backside and a second backing denominated the secondary backing is laminated thereto. Until recently, the secondary backing in quality pile fabrics, particularly carpet fabrics, was almost exclusively a jute fabric. This natural material however, is now in relatively short supply and attempts have been made to prepare synthetic secondary backings to replace those heretofore made of jute. The criteria for a successful material are that it should not only perform like a jute fabric in terms of adhesion and fabric strength but, perhaps most importantly, it should be as inexpensive as jute.

In terms of price and strength, the polyolefins in particular among synthetics, are extremely attractive and offer in addition, their renowned resistance to chemicals, water, mildew etc. The use of polyolefins has not met with complete success however, mainly because of their poor adhesive qualities and because polyolefin materials treated so as to improve adhesion either have no fabric strength or have an aesthetically unacceptable appearance.

The present invention is predicated on a discovery that a broadly utilitarian fabric can be prepared which is woven from synthetic components and has the combination of good strength, where required, the appearance and low cost of a jute fabric and good adhesion when used as a synthetic secondary backing for pile fabrics such as carpets and the like.

The fabric is preferably woven in a conventional plain weave using synthetic ribbons as either the warp or fill members and heavily fabrillated material as the other members. Other weave constructions, for example, twill, broken twill, satin or sateen, basket, etc., can all be used to good advantage and may sometimes be preferred if it is desired to have more or less fabrillated material exposed on one side of a fabric. In general, almost any weave construction known to the textile artisan can, with his ordinary skill, be used in carrying out the invention. In the following description all fabrics are plain weave as this is a most common weave construction, is broadly used, and is a most durable, strong, firm and most dimentionally stable method of interlacing warp and fill components into a fabric.

When the fabric is intended to be used as a secondary backing, it is usually woven so as to have an open structure to facilitate passage of the adhesives normally used to adhere the backing to pile fabrics or carpet structures. In this context, the weave can be one that has from about 10 to about 30 ribbon ends per inch (warp) or picks (fill), of about 500 to about 1000 denier and from about 8 to about 12 heavily fabrillated ribbon picks (fill) or ends per inch (warp) of about 800 to about 2800 denier. Useful secondary backings are obtained when the fabric has 12 ribbon warp ends per inch and 9 heavily fabrillated fill picks (12 × 9), as well as when the fabric has 14 to 15 ribbon warp ends per inch and about 9 heavily fabrillated fill picks (14 × 9). Useful primary backings are obtained when the fabric has from 10 to about 30 warp ends per inch and from about 6 to about 12 heavily fabrillated fill picks. The weaving specifics are not critical, and as noted above are considered to be within the skill of the art and will depend upon the characteristics desired for the resultant fabric in its end use.

As has been indicated previously, the fabric described can also be prepared wherein the warp ribbons are the heavily fibrillated members and the fill members are ribbons, the warp end count and fill picks being correspondingly altered so that the heavily fabrillated member count remains approximately the same.

The term "ribbon" used herein, means that the members or components of the warp and/or fill woven into the fabric preferably have a flat appearance and are generally rectangular in cross-section. For the purposes of the present invention, a "ribbon", "ribbon yarn" or member etc., as used herein includes, in addition to the above, tapes, tubes, sheets or strips of synthetic resinous material whether or not of rectangular cross-section. Thus, other cross-sectional shapes, round, oval, the so called "dumb bell" and combinations of these shapes can be used. Multifilament ribbons are also within the purview hereof, whether held together as by adhesives, or loosely combined in a continuous cluster to form a warp or fill member of the fabric, and whether fabrillated or not. Inclusive herein are other terms such as narrow films, strands, bands, fibers, threads, yarns and yarn elements whether monofilament constructions or multifilaments and whose cross-sections may vary from round to rectangular, uniform or non-uniform, or symmetrical or asymmetrical.

Ribbons or ribbon yarns can be made by slitting a film or by extrusion from individual orifices depending upon their form and shape. In either method, the material of the ribbons is oriented, usually by drawing. Final ribbon dimensions are determined by the amount or degree of orientation and original dimensions of the ribbons prior to orientation.

By heavily fibrillated members or ribbons is meant a product or fiber which is formed into structure having many fibers or fibrils which have lower deniers than the original product. The fibrils may be connected with one another or not, depending upon the method of fabrillating the ribbon. The ribbon may be formed into a web or net-like structure consisting of one or more, more or less parallel, longitudinally extending backbones or stem-like fine fibrils connected by even finer fibrils. This structure can be formed by any well-known method, for example, the rotating pin roller consisting of spaced rows of pins mounted on the periphery of a roller over which the ribbon is drawn at a speed somewhat less than the peripheral speed of the roller whereby laterally spaced apart, longitudinally extending perforations or slits disposed in spaced, staggered parallel relationship are formed in the ribbon, the slits being so disposed that expansion of the strip or ribbon in a lateral direction reveals the net-like structure. In a variation of this means, the roller consists of peripherally mounted rows of hacksaw blades which rotate in relation to the moving ribbon to form the staggered slits or perforations and the fibrils along the length of the ribbon. The fabrillated ribbon can also be prepared by an embossing method wherein a grooved or embossing roll rotates against a second roll, the ribbon passing therebetween. The embossed ribbon is then oriented. Orientation causes rupturing in the thinner sections resulting in a fibrillated ribbon. U.S. Pat. No. 3,369,435, filed Dec. 6, 1967, issued Feb. 20, 1968 to H. D. Boultinghouse illustrates a rotating pin roller technique that can be adapted for making heavily fabrillated ribbon.

As used hereinafter, heavily fabrillated refers to products having fine fibril backbones or stems connected by even finer fibrils resembling a web or net-like structure wherein the connecting fibrils have a denier of less than 250, ranging from about 3 to about 250, the average denier ranging from about 12 to about 150. A preferred heavily fabrillated ribbon is one having the above described web or net-like structure with interconnecting fibrils having a denier ranging from about 3 to about 235 with an average denier of from 12 to about 125. A particularly preferred heavily fabrillated ribbon is one in which the fibrils have a denier of 3 to about 235 with an average denier of from 12 to about 150, a majority of the fibrils having a denier of less than 60, and at least 30% of the fibrils in the network have an average denier of from 12 to about 35.

While my earlier work suggested that 60 denier was an upper limit respecting the degree of fibrillation, it has been found that deniers as high as 250 can successfully be employed to prepare useful fabrics.

Preferred ribbons used are from 0.5 to about 4 mils thick and 30 to 200 mils wide, more preferably from about 1.0 to about 3.0 mils thick and 50 to 150 mils wide. A particularly preferred ribbon is about 1.5 to 3.0 mils thicks and from about 60 to about 100 mils wide, and can have smooth or delustered surfaces. A preferred fabric is woven in a plain weave for convenience and on an ordinary double-heddle loom using the above ribbons in the warp and the heavily fibrillated ribbons in the fill. Some of the warp yarns may be folded during weaving which beneficially aids in maintaining the strength of the fabric while providing a somewhat more open weave having interstices that facilitate the passage of the latex adhesives normally used in the carpet industry. Ribbon yarn folding during weaving, however beneficial, is not necessary to the successful carrying out of the invention.

The heavily fibrillated yarn is obtained by various means in any convenient manner. For fibrillation, the film can be from about 0.5 to about 3 mils thick, more often from about 0.5 to about 2 mils thick and of almost any desired width. It has been found convenient to slit a wide film of these thicknesses into ribbons or about 0.25 inch to about 1.0 inch wide and thereafter fibrillate them. It has also been advantageous to deluster the film or ribbon prior to fibrillation by running the film over a rotating sandpaper covered roll.

The preceding description illustrates another advantage that is derived from the present invention and that is that the fabric can be prepared with warp and fill members from a single extruded film. In this instance, the film is slit into ribbons of approximate width which can thereafter be used as desired. For example, the extruded film can be slit into one or more wide films and each of these films further slit into ribbons of the desired width depending upon their use as ribbon members or fibrillated members in the fabric. Thus, both members can be produced from a single extruder from the same source of material and in a continuous, uninterrupted process. Alternatively, the ribbons of different widths can be prepared on a single slitter which has its slitting elements suitably arranged to slit the film into ribbons of the desired widths, after which the ribbons are oriented, delustered if desired, and separated according to whether they are to be fibrillated or used directly in weaving the fabric.

A preferred method for preparing heavily fabrillated ribbon yarn utilizes the above mentioned film slitting technique to form ribbons of suitable dimensions which are thereafter oriented, then transported over a rotating roll fitted with pins on the outer periphery at specified angles. The ribbon is perforated in a pattern of slits determined by the pin positions, the angle of the pins and the ribbon speed in relation to the peripheral speed of the roller. The result is the web or network of fine fibers or fibrils interconnecting the longitudinally extending branches, ribs, backbones or channels above described. A particularly desirable pin roll is one in which there are parallel multiple rows of pins, up to 90 or more, positioned around the periphery of the roll, the pins in each row being off-set a specified distance with corresponding pins in each other row to create a pattern of pin positions which is repeated several times over the entire roll surface. The pins are angled toward the approaching ribbon to facilitate disengagement of the pins from the fibriliated ribbons. As mentioned above, the roll rotates at a speed somewhat faster than the ribbon moving thereover in a ratio of roll to ribbon speed of in excess of 1.0 to about 2.5 times depending upon the extent and type of fibrillation network desired. After the ribbon is fibrillated it is wound up on a package for use as the fill or warp members in the woven fabric. A fibrillation method or technique employing the pin roller that has been useful is described in detail in Example A herein.

In addition, synthetic materials can be prepared which have flame retardant properties and used as the ribbons in the present fabrics, by blending them with one or more flame retardant additives. The polyamides in general have good flame resistant qualities. Other extrusion nylons, e.g. modified phenylene oxide based resins, are available which have excellent flame retardant properties and can be used herein. Brominated polyester is available as a flame retardant material and can be used, as well as polyester compounded with halogenated hydrocarbons. Many additives, both organic and inorganic are known and can be used to produce flame retardant polyester and the polyolefins. For example, these synthetics can be compounded with chlorinated paraffins, either singly or in combination with antimony oxide. Combinations of halogenated organic compounds and antimony oxide are also well-known as are perchloropentacyclodecane and related products. New bromine substituted aromatics and mixed halogen substituted aliphatics have recently been introduced and may also be used with the polyolefins, polyproplyene in particular. Other additives which can be used include, but are not limited to inorganics such as tri-hydrated aluminum oxide, and antimony oxide dispersions. The advantages a flame retardant carpet backing are apparent — safer, fire resistant carpeting can be supplied to those areas and locations where flame retardant materials are required by present day regulations, building codes, and State and Federal statutes.

A useful method for determining fibril denier is one based on direct observation and mensuration of a selected number of fibrils from the fibrillated member. In this method fibril specimens are embedded in a plastic matrix and cut to reveal cross-sections. The cross-sectioned specimens are viewed through a microscope, the fibril width and thickness determined by direct measurement, and the denier calculated. Alternatively, photomicrographs of the fibrils are made, the fibril width and thickness are scaled therefrom and the denier calculated.

To insure obtained a reasonably representative fibril denier profile, from 30 to over a 100 or more observations should be made. In another method for determining fibril denier, also based on direct observation, a Shadowgraph with a 10 power graduated width gauge lens is used. Specimens are mounted and viewed on smooth surfaced circular steel rods. Observations of fibril lengths and thicknesses and denier computations are made in sets up to 30 fibrils.

Fibril denier can also be determined by vibroscope as described in ASTM Designation D-1577, "Linear Density of Textile Fibers," Method A-Vibroscope method. This method is based upon a determination of the fundamental resonant frequent of tranverse vibration in a fiber (or fibril) being measured and is primarily used to measure denier is symmetrical fibers. The fibrils of interest herein, obtained by fibrillating a ribbon, are asymmetrical and variations in resonant frequency may be observed depending upon positioning of the fibrils in the apparatus; it may therefore be difficult to obtain measurements using the vibroscope method.

Once the fabric has been woven of ribbons in one direction (warp or fill) and heavily fibrillated yarns in the other direction, it can be used directly. If the fabric is to be used for secondary carpet backing, further processing is preferred to disconnect some of the fibrils from the web or network and raise the ends of the fibrils above the surface of the fabric. In a preferred embodiment of such further processing, the woven fabric is brushed. One brushing means is rotating brush having relatively stiff bristles which rotate in an apparatus against the fabric surface. Some good results have been found with a brush having nylon bristles moving at a speed of from 60 to 75 feet per minute and having a depth of penetration of from 1/16 to 3/32 inches into the fabric.

Best results have been found with a brushing or napping machine manufactured by the Woonsocket Napping Machinery Co., Inc. of Woonsocket, Rhode Island, which is double action, multiple clothing roll machine. The fabric is run through the rolls at a speed of 75 feet per minute. The machine is equipped with pile clothing (up to 36) rolls comprising open-set metal wires and counterpile rolls having similar clothing but facing oppositely from the pile clothing wires. The clothing wires appear in elevation as opened letter L's with chisel-like points which enter the fabric to a depth of from 1/16 inch to 5/32 inch, preferably about 3/32 inch to disconnect and lift the heavily fibrillated ribbon fibril ends above the fabric surface.

In another embodiment of aftertreatment or further processing the woven fabric is first lightly penetrated by barbed needles. These needles are aligned so that the non-fibrillated ribbons are relatively unaffected, mostly the fibrillated mebers being affected. The alignment is such that the non-fibrillated members remain unfibrillated or substantially so. Some slight effect such as minor splitting may be evident on the unfibrillated members by this aftertreatment; however, such effect is desirably minimal and the ribbon remains substantially unfibrillated. The effect is again to disconnect the fibrils of the fibrillated members from the web or network and raise the ends above the surface of the fabric. As indicated in both modes of aftertreatment the fibrils become at least in-part disconnected from the web or network and thereafter the fibril ends are raised above the surface. In still another embodiment the fabric, after weaving, is first subjected to penetration by barbed needles as described above, and thereafter brushed, or napped, either with a nylon bristled rotary brush or a clothing roll napper. It has been found that combining these aftertreatment steps result in a secondary carpet backing having excellent delamination strength, high strength retention and good dimensional stability with fibrils having deniers as high as 250.

By penetration by barbed needles is meant that the fabric is subjected to an array of needles mounted in parallel rows on a needleboard which is reciprocated to cause the needles to penetrate the fabric. The fabric is passed under the needleboard at a predetermined speed of from 20 to about 40 feet per minute and the needles are reciprocated at about 350 to about 800 strokes per minute, preferably from about 400 to about 750 strokes per minute. The needles are, as stated, arranged in the board in generally parallel rows and in sufficient number to penetrate the fabric at rates ranging from about 100 to about 300 penetrations per square inch of fabric, preferably about 150 to about 270 penetrations per square inch.

A particularly preferred needle is a so-called "pinched barbed" needle manufactured and supplied by the Foster Needle Co., of Manitowoc, Wisconsin, under its designation "PB-30", and identified by the standard needle gauge number 15 × 18 × 32 × 3.0 or 3.5. The latter number is well-known to the skilled artisan; this particular needle is one having two rows of two barbs in each row on the shank of the needle, the rows being 180° opposed and each barb in one row being displaced a short distance from the corresponding barb in the opposite row.

The needles, as stated above, are fixed to the reciprocating needleboard. They are arranged in rows with the barbs facing the direction of fabric travel (i.e. parallel to the warp members in the fabric if the fill members are the fibrillated members). By this orientation and selection of the needles with respect to the fabric, damage to the warp yarns is minimized while fibril end lifting is maximized. The needles are set to penetrate to a depth ranging from about ⅝ inch to about9/16 inch; this depth coupled with from 205 through 290 penetrations per square inch have given satisfactory results, with best results being achieved in the needle depth range of from ⅝ inch to 15/32 inch. A particularly preferred combination is 7/16 inches of depth with 265 penetrations per square inch.

As hereinbefore mentioned, a fabric aftertreated by needling can be further improved by further aftertreating by brush or napping to increase surface hairiness and adhesion when used as a secondary backing.

A further embodiment of this invention is contemplated within the purview hereof wherein the heavily fibrillated ribbon itself is treated prior to weaving to disconnect some or most of the fibrils from the web or network and raise the ends from the body of the ribbons. For example, the heavily fibrillated ribbon prior to rewinding, can be contacted while moving by a clothing brush or roll having wires as above described which will cause the fibrils to be disconnected and the ends raised up from the body of the moving ribbon. The treated fibrillated ribbon is then collected on packages and transported to the loom for weaving into the textile fabric. Other means for treating the heavily fibrillated ribbon to accomplish fibril end raising are air or grit blast, directed against the moving ribbon, contacting the ribbon with emery or sandpaper and needling.

Delamination strength is determined by adhering a secondary backing to a faced fabric, pile fabric or soft carpet fabric using a commercial rubber latex compounded with 73% solids and measuring the force in pounds required to peel the secondary backing from the soft carpet fabric of a strip 3 inches wide at a rate of 12 inches per minute. This test is standard throughout the carpet industry and a value of less than 7.5 pounds is considered unacceptable.

In addition to having good adhesion, woven prepared herein are acceptably high in tensile strength. Tensile strength, or, as used hereinafter, "Grab Strength", as described in ASTM Designation D-1684-64, may be defined as the maximum load which can be imposed in stretching or pulling a specimen piece of fabric 4 × 6 inches in each of the warp and fill directions at a rate of 12 inches per minute in a long (6 inch) direction prior to rupture, the fabric being gripped in 1 inch jaws, 3 inches apart, the long direction being the warp in one case and the fill in the other case. The maximum force in pounds at rupture is recorded and designated breaking strength or pounds to break (lbs-bk). In some instances, the percent elongation is simultaneously recorded and may be noted.

Acceptable fabrics should have Grab Strengths in excess of 30 pounds in the warp and 25 pounds in the fill, preferably in excess of 40 pounds in the warp and 30 pounds in the fill. The fabrics prepared in accordance herewith have tensile or Grab Strengths in excess of these values in both directions.

The invention is further illustrated by the following examples, and it should be noted that although polypropylene has been used herein, comparable results can be obtained with other synthetic thermoplastic materials, including polyamide, polyester, and other polyolefins as well as mixtures thereof.

EXAMPLE A

This Example illustrates a preferred process for preparing the fibrillated ribbon.

A polypropylene film approximately 20 inches in width and 2.5 to 3.0 mils thick was extruded through a screw extruder, the heat zones from feed end to die in the extruder increasingly varying from 400° to 470° F. After leaving the extruder, the film was hot stretched in air before being quenched in an 80° F. water-bath. The film was then slit into equal width ribbons and oriented passing them through increasingly hotter zones from 250° to 310° F., for a total orientation of 6.3 to 1.0. The ribbons were annealed at 310° F., and delustered by passing them over rotating sandpaper covered rolls.

The delustered ribbons were then fibrillated by contacting a pin roller over an arc of approximately 40°. The ribbons entering the pin roll were under tension and left the roll under about half the initial tension. The pins were arranged around the roll periphery in 90 rows, over 30 pins to the inch in each row and mounted at an angle less than perpendicular to the roll surface. The pins were alternately off-set from row to row a distance of under 0.005 inches and repeated several times around the roll. The ratio of roller speed to ribbon speed was 1.2:1 to 1.5:1.

The ribbon thus fibrillated was wound onto packages by a winding machine. Some of the fibrillated ribbon was twisted 0.5 to 1.52 T.P.I. and the remaining ribbons were left untwisted. Both ribbons were rewound on a rewinding machine. After winding, the packages were transported to looms for weaving into fabrics as twisted or untwisted warp or fill yarns therein with polypropylene ribbon.

The fibrillated ribbons above prepared had a denier of approximately 2300, a tensile strength in excess of 10 pounds (ribbon yarn tenacity 2.0 grams per denier), and low shrinkage (under 1.5% tested at 270° F. for 15 minutes). Fibrillation was characterized visually by laterally expanding a portion of the ribbon to reveal multiple, longitudinally extending backbones, branches, stems or ribs with a laterally deployed, connecting lattice of fine fibers or fibrils.

EXAMPLE 1

Several polypropylene, heavily fibrillated 2200 denier ribbons were prepared, fibrillated to varying degrees of fineness by varying the pin roll speed ratios in accordance with Example A. The heavily fibrillated ribbons were designated Fibrillated Ribbon No.1, Fibrillated Ribbon No. 2 and Fibbrillated Ribbon No. 3-fine, medium and coarse fibrillation respectively.

Fibrillated Ribbon No. 1: speed ratio — 1.45:1
Fibrillated Ribbon No. 2: speed ratio — 1.31:1
Fibrillated Ribbon No. 3: speed ratio — 1.21:1.

The fibrillated ribbons were wound on tube packages and transferred to the loom for weaving into fabrics. Some of the packages of Fibrillated Ribbon No. 1 were untwisted; the rest of Fibrillated Ribbon No. 1 and Fibrillated Ribbon Nos. 2 and 3 were twisted 0.8 to 1.5 Z TPI.

The fibrillated ribbons all had the feel and appearance of jute. The deniers of the fibrils, which fibrils gave the ribbon its "hairiness", were determined by microscopic examination of fibril cross-sections. The deniers are presented below together with an analysis of their distribution in the fibrillated ribbon examined.

| Fibrillated Ribbon No. | Total Fibrils Observed | Denier Avg. (range) | % of Fibrils being 60 Denier or less | % of Fibrils in range of 12 to 35 Denier |
|---|---|---|---|---|
| 1 | 90 | 43 (3 to 174) | 78.8% | 52.1% |
| 2 | 80 | 54.9 (3 to 163) | 68.7 | 49.9 |
| 3 | 50 | 96.8 (7 to 203) | 44.0 | 32.2 |

EXAMPLE 2

Sample fabrics were woven in a plain weave with Fibrillated Ribbon No. 1 of Example 1 and designated A, B, C and D as follows:

Sample A: 12 unfibrillated 1000 denier polypropylene ribbon warp member ends per inch, and 9 untwisted fill picks of Fibrillated Ribbon No. 1 of Example 1.

Sample B: same construction as Sample A above except that the Fibrillated Ribbon No. 1 of Example 1, was twisted 0.8 to 1.0 Z twists per inch (TPI).

Sample C: 10 untwisted Fibrillated Ribbon No. 1 of Example 1 warp member ends per inch and 9 untwisted Fibrillated Ribbon No. 1 of Example 1, fill picks.

Sample D: 10 Fibrillated Ribbon No. 1 of Example 1, twisted 0.8 to 1.0 Z TPI, warp member ends per inch and 9 untwisted Fibrillated Ribbon No. 1 of Example 1, fill picks.

The sample fabrics were all directly brushed on a clothing roll napper supplied by the Woonsocket Napping Machine Co., Inc., Woonsocket, Rhode Island, and laminated to a soft tufted carpet fabric with a commercial latex laminating compound with 73% solid content. Three delamination tests comprising pulling a 3 inch strip of the fabric from the soft carpet at 12 inches per minute were performed on each Sample and 3 Grab Strength tests as described in ASTM designation D-1634-64 were also performed. The average results of the three tests on each Sample are presented below:

| SAMPLE | A | B | C | D |
|---|---|---|---|---|
| Delamination Strength (lbs/3" strip) | 10.2 | 7.5 | 14.0 | 14.5 |
| Grab Strength (lbs-bk) | | | | |
| Fill | 96 | 123 | 101 | 110 |
| Warp | 111 | 101 | 100 | 111 |

EXAMPLE 3

A fabric was prepared as in Example 2, using 1000 denier unfibrillated polypropylene ribbons as the warp members, 12 ends per inch, about 100 mils wide by 1.5 to 2.0 mils thick, and approximately 9 picks of 2100 denier heavily fibrillated polypropylene ribbons as the fill members. The fill members were fibrillated by pin roller, generally in accordance with Example A, and had fibrils ranging from about 4 to about 31 by Vibroscope measurement of 50 randomly selected fibrils, with an average denier of 22.99. The fibrillated members were twisted 1.5 Z TPI. The fabric was aftertreated by brushing with the clothing roll napping machine of Example 2.

The fabric was then laminated to a soft carpet fabric with the latex laminating compound of Example 2 and 3 delamination and Grab Strength tests were performed also as in Example 2. The average results of these tests are given below:

| | |
|---|---|
| Delamination Strength (lbs/3" strip) | 10.0 |
| Grab Strength (lbs-bk) | |
| Fill | 115 |
| Warp | 87 |

This Example illustrates a fabric wherein the heavily fibrillated yarn is of much lower average denier and, though twisted, delamination strength in excess of 7.5 pounds was obtained and fabric strength maintained.

From the foregoing Example, it is seen that aftertreatment by brushing with a clothing roll napping machine is an effective means to raise fibril ends from the fibrillated members and provide fabrics having delamination strengths of 7.5 pounds and higher. It is further seen from Samples C and D that adhesion is enhanced when both members of the fabric are heavily fibrillated.

Needling was performed under varying conditions with 18 × 15 × 32 × 3.5 gauge Foster Type PB-30 needles oriented to strike the fabric at a depth of 7/16 inch. The fabric was brushed (Samples A–C) following needling. One fabric (Sample D) was needled without brushing, as shown below:

Sample A: Needleboard speed-700 strokes per minute (S/M); Fabric speed-24 feet per minute (ft./min.); Needle penetration rate-265 penetrations per square inch (p/in$^2$); Brushing as above described.

Sample B: Needleboard speed-550 S/M; Fabric speed-24 ft./min; Needle penetration rate-208 p/in$^2$; brushing-as above described.

Sample C: Needlebroard speed-400 S/M; Fabric speed-24 ft/min.; Needle penetration rate-150 p/in$^2$; brushing-as above described.

Sample D: Needleboard speed-700 S/M; Fabric speed-24 ft/min.; Needle penetration rate-265 p/in$^2$; *No Brushing.*

An additional sample, designated Sample E, was run in which the fabric, after weaving was *brushed only* with a nylon brush roll under the conditions set forth above.

An unneedled and unbrushed fabric having Fibrillated Ribbon No. 1 of Example 1 as fill members was run as control.

The results of the tests including fibril deniers measurements are presented in Table I below.

TABLE I (EXAMPLE 4)

| SAMPLE | NEEDLED AND BRUSHED A (700S/M-265p/in$^2$) | | NEEDLED AND BRUSHED B (550S/M-208p/in$^2$) | | NEEDLED AND BRUSHED C (400S/M-150p/in$^2$) | | Needled Only D (700S/M-265p/in$^2$) | | Brushed Only E | | Control (Fibrillated Ribbon No. 1-Ex. 1) | |
|---|---|---|---|---|---|---|---|---|---|---|---|---|
| Delamination Str. (lb/3") | 16.0 | | 13.1 | | 10.9 | | 13.4 | | 4.65 | | No Test | |
| Grab Strength lbs-bk. | Fill 33.0 | Warp 70.5 | Fill 37.5 | Warp 68.5 | Fill 47.0 | Warp 73.5 | Fill 31.5 | Warp 68.0 | Fill 92 | Warp 92 | Fill 122 | Warp 101 |
| Fibril Denier (a) No of Obser. | 96 | | 93 | | 112 | | 111 | | 102 | | 90 | |
| (b) Avg. Denier (range) | 42.1 (4–174) | | 43.5 (6–208) | | 39.2 (4–123) | | 36.8 (3–169) | | 41.7 (7–178) | | 43 (3–174) | |
| (c) % of (a) 60 denier or less | 76.0 | | 81.7 | | 80.3 | | 84.2 | | 78.7 | | 78.8 | |
| (d) % of (a) in range 12–35 denier | 42.7 | | 58.4 | | 50.0 | | 63.2 | | 57.5 | | 52.9 | |

Twisting has little if any effect to adhesion. Samples A and B indicate some adverse effect on adhesion; however, all samples were acceptable. Strength in both fill and warp direction is maintained in all samples and is significantly higher when compared to prior art fabrics (see Example 8 comparison with prior art fabrics).

EXAMPLE 4

Several fabric samples were woven using Fibrillated Ribbon No. 1 of Example 1 as the fill members. The warp members were 1000 denier polypropylene ribbons 65 to 80 mils wide and 1.5 to 2.0 mils thick; the fabric constructions were all approximately 12 × 9. The samples after weaving were subjected to aftertreatment: Some to both needling and brushing, some to needling alone and others to brushing alone. All brushing was performed with rotary nylon brush rotating at 75 feet per minute penetrating to a depth of 1/16-3/32 inch in the fabric. The fibril deniers after the above treatments were determined from measurement by microscopic examination of fibril cross-sections. Delamination and Grab Strength tests were also performed.

From the foregoing Example it is seen that a variety of aftertreatments are effective to provide fabrics having delamination strengths in excess of 7.5 pounds. It is particularly noted that Sample A, having a delamination strength of 16 pounds compares with the adhesive qualitites of jute fabrics and spun polyester fill fabrics, as shown in Table 1. For this reason, Sample A is a particularly representative embodiment of the invention. Secondary backing fabrics can therefore be prepared having adhesion strengths to 16 pounds, fill member strengths well above 30 pounds and warp member strengths over 65 pounds.

EXAMPLE 5

Example 4 was repeated using Fibrillated Ribbon No. 2 of Example 1. The conditions for Samples A, B, C, D and E of Example 4 were duplicated for the corresponding sample of this Example. The control fabric was prepared using Fibrillated Ribbon No. 2 of Example 1 as the fill members; it was unneedled and unbrushed. The results of the tests are presented in Table II below:

TABLE II (EXAMPLE 5)

| SAMPLE | NEEDLED AND BRUSHED A (700S/M-265p/in²) | B (550S/M-208p/in²) | C (400S/M-150p/in²) | Needled Only D (700S/M-265p/in²) | Brushed Only E | Control (Fibrillated Ribbon No. 2-Ex. 1) |
|---|---|---|---|---|---|---|
| Delamination Str. (lb/3") | 13.7 | 11.8 | 8.8 | 12.8 | 4.3 | No Test |
| Grab Strength lbs-bk. | Fill 30 Warp 65.5 | Fill 47.0 Warp 70.0 | Fill 46 Warp 72 | Fill 37 Warp 69 | Fill 108 Warp 91.5 | Fill 94 Warp 105 |
| Fibril Deniers (a) No of Obser. | 83 | 96 | 99 | 89 | 88 | 80 |
| (b) Avg. Denier (range) | 47.2 (3-198) | 45.2 (4-168) | 47.8 (7-147) | 45.8 (6-178) | 53.8 (4-208) | 54.9 (3-163) |
| (c) % of (a) 60 denier or less | 79.5 | 75.0 | 67.6 | 77.5 | 70.5 | 68.7 |
| (d) % of (a) in range 12-35 denier | 46.9 | 52.1 | 53.7 | 60.7 | 47.7 | 49.9 |

EXAMPLE 6

Example 4 was repeated using Fibrillated Ribbon No. 3 of Example 1. The conditions for Samples A, B, C, D and E of Example 4 were duplicated for the corresonding sample of this Example. The control fabric was prepared using Fibrillated Ribbon No. 3 of Example 1 as the fill members; it was unneedled and unbrushed. The results of the tests are presented in Table III below:

TABLE III (EXAMPLE 6)

| SAMPLE | NEEDLED AND BRUSHED A (700S/M-265p/in²) | B (550S/M-208p/in²) | C (400S/M-150p/in²) | Needled Only D (700S/M-265p/in²) | Brushed Only E | Conrol (Fibrillated Ribbon No. 3-Ex. 1) |
|---|---|---|---|---|---|---|
| Delamination Str. (lb/3") | 10.8 | 8.6 | 6.9 | 9.3 | 4.05 | No test |
| Grab Strength lbs.bk. | Fill 44 Warp 70 | Fill 51.5 Warp 71 | Fill 62 Warp 72 | Fill 40 Warp 67 | Fill 136 Warp 98 | Fill 96 Warp 101 |
| Fibril Deniers (a) No of Obser. | 74 | 70 | 64 | 61 | 57 | 50 |
| (b) Avg. Denier range 57.5 (7-218) | 67.1 (4-233) | 70.6 (8-245) | 75.4 (8-253) | 88.1 (4-233) | 96.8 (7-203) | |
| (c) % of (a) 60 denier or less | 79.7 | 68.5 | 54.7 | 57.4 | 47.3 | 44.0 |
| (d) % of (a) in range 12-35 denier | 51.3 | 44.3 | 31.2 | 45.9 | 38.5 | 32.0 |

Examples 4, 5 and 6 show that a variety of aftertreatment methods can be employed to provide fabrics having acceptable adhesion. They further show that aftertreatment can overcome the effect of high fibril denier. As has previously been noted, adhesion tends to be a function of denier; in general the finer the fibril (lower the denier) the greater the adhesion. The results obtained in Examples 4, 5 and 6 show that delamination strength increases as needling increases from 400 strokes per minute/150 penetrations per square inch to 700 strokes per minute/265 penetrations per square inch—a finding consistent with the fact that increased needling disconnects more fibrils from the web or network and raises more fibril ends above the plane of the fabric. In Samples C and D of Example 6, Table III it is seen that, whereas needling at a rate of 400 S/M-150 p/in² provides a delamination strength of 6.9 pounds for a fabric whose fill component has an average denier of 70.6, a needling rate of 700 S/M-265 p/in² provides a delamination strength of 9.3 pounds for a fabric whose fill component has an average denier of 75.4.

In Examples 4-6 all brushing was done with a rotary brush having relatively stiff plastic bristles. The results obtained with such brushing as the sole aftertreatment were not acceptable. However, shown in Examples 2 and 3 acceptable fabrics were prepared when the aftertreatment was done with the metal wire clothing roll brush.

EXAMPLE 7

A woven synthetic fabric was prepared using 1000 denier polypropylene ribbons as the warp members. The ribbon dimensions were 110 mils wide by 1.5 to 2.0 mils thick. The ribbons were run through a special reed on the loom which folded some of the ribbons longitudinally thereby spacing them apart such that when woven with heavily fibrillated ribbon as the fill members, up to 50% air space was present in the loom reed. The fabric was a plain weave construction with ribbon warp ends per inch and 9 fill picks (actual 11.7 × 10.3 warp to fill).

The fill members were 2000 denier polypropylene ribbons which were heavily fibrillated by pin roller, generally in accordance with Example A above, prior to weaving into the fabric with fibrils having a denier of from about 5 to about 60 by vibroscope measurement of 50 randomly selected fibrils with an average denier of 25.26. The fibrillated ribbon was given a 1.5 Z-twist per inch (1.5 Z TPI) and wound up on a package for weaving on a loom. The fabric thus woven was then subjected to aftertreatment by barbed needles disconnect the fibrils from the web or network and raise their ends above the surface. The fabric surface was found to have an increased number of fibrils and was seen to present a very hairy or fuzzy appearance, aesthetically similar to woven jute. A final brushing by hand was administered to the fabric to further raise the fibril ends above the surface of the fabric.

The fabric thus treated was then laminated with a commercial latex laminating compound with 73% solids content to a soft carpet fabric comprising a face pile tufted into a closely woven synthetic ribbon woven fabric, or primary backing, and a coating of latex supplied to the underside thereof to lock in the tuffs. After lamination and curing of the latex, the fabric was subjected to a delamination or bond strength test. This test comprises peeling away a 3 inch strip of the backing at a rate of 12 inches per minute while noting the force required. The results obtained from this test are set forth below. Grab strength tests as described in ASTM Designation D-1682-64 were also performed. Delamination Strength (lbs.):7.4, (average of 3 tests, ranging from 6.8 to 7.8)

| Grab Strength (avg. of 3 tests) | Fill Warp (range) | |
|---|---|---|
| lb-bk | 91 (89–92) | 58 (54–65) |

EXAMPLE 8

This Example illustrates an attempt to duplicate the teaching of U.S. Pat. No. 3,542,632 to Eickhoff et al., and accordingly, to test Eickhoof's teachings, several woven textiles were prepared and fibrillated by barbed needles as described in the patent to Eickhoff et al. Each fabric, before fibrillation, was made in conformance with the following description and the patentee's teachings.

Fabric: Loosely woven of polypropylene ribbons oriented (5–6 times), in a plain weave of 12 × 8 construction with interstices between the yarns and dimensionally stabilized by heat treatment.

Warp: Polypropylene ribbons formed by extrusion through a rectangular diehead, 2.0 to 2.5 mils thick, 75 to 100 mils wide, 12 ends per inch.

Fill: Polypropylene ribbons formed by extrusion through a rectangular diehead, 100 mils wide by 2.0 mils thick, 8 picks.

The fabric samples were designated alphabetically as follows: Samples A, B, C, D and E, and each was fibrillated by barbed needles, the particular needle selected being substantially the same as that shown in FIG. 4A of U.S. Pat. No. 3,542,632 to Eickhoff et al. Severity of fibrillation from Sample A through Sample E was varied; fibrillation of Sample A being least severe and fibrillation of Sample E being most severe. Severity was correlated on a scale of needle penetrations per square inch as indicated below. The data show that fabric strength decreases with severity of fibrillation.

| Sample | Fibrillation-Severity (needle penetrations per sq. in.) | Delamination (lbs. per 3" strip) | Grab Strength (lb-bk) Warp | Grab Strength (lb-bk) Fill |
|---|---|---|---|---|
| A | 180 | 5.8 | 31 | 27 |
| B | 300 | 5.9 | 30 | 26 |
| C | 400 | 6.7 | 24 | 19 |
| D | 500 | 7.2 | 24 | 13 |
| E | 600 | 8.0 | 24.5 | 14 |
| Control | (unneedled) | 1.75 lbs. | 99.0 | 59.0 |

This Example illustrates an advantage of this invention. One defect in the secondary carpet backing taught by Eickhoff et al., as seen from the foregoing Example, is that fibrillation severe enough to provide acceptable adhesion to a primary carpet backing, as measured by delamination strength, substantially weakens the fabric, thus tensile strength in the fill direction drops from 59 pounds to 14 pounds; tensile strength in the warp direction drops from 99 pounds to 24.5 pounds. It is seen that the tensile strength of a fibrillated fabric prepared by the method of Eickhoff et al., having acceptable adhesion to a soft carpet, is one-quarter what it was prior to fibrillation.

The present invention is characterized by ease, convenience and efficiency of manufacture, providing a woven textile having acceptable adhesion without sacrificing strength.

EXAMPLE 9

A fabric was prepared with tan colored 1000 denier polypropylene ribbons as warp component, and tan 2000 denier heavily fibrillated polypropylene ribbon twisted 1.50 TPI as the fill component; the fill component was supplied by the Hercules Company, Wilmington, Delaware. The fabric was woven in a plain weave construction, 12 warp ends per inch and 9 fill picks. Some of the warp components were folded by means of a special reed on the loom. The fill component was about 2000 denier and heavily fibrillated. The fibril denier by vibroscope measurement of 50 randomly selected fibrils was from about 7 to about 31 with an average denier of about 21.06. The fabric was subjected to aftertreatment by barbed needles followed by hand brushing. It was laminated to a soft carpet and evaluated, providing the following delamination and Grab Strength results:

| Delamination Strength (lbs): 8.8, (range: 8.6 to 9.0)-3 tests (lbs/3" strip) | | |
|---|---|---|
| Grab Strength | Fill (range) | Warp (range) |
| lb-bk | 51 (48–46) | 57 (54–59) |
| No. of tests | 3 | 3 |

EXAMPLES 10–13

Several backing sample fabrics were woven of different materials for a comparison of delamination strengths with fabrics having fibrillated members. Each sample consisted approximately of a 14 × 9 weave construction, the warp in each sample being 1000 denier polypropylene ribbons, 75 to 100 mils wide with some folding in weaving by a reed having 14.4 openings between the reed wires, or dents per inch. One warp end per dent with an air spacing of 49.6% in the reed. The fill members were as follows:

EXAMPLE 10

Tan colored 2100 denier, 1.5 TPI heavily fibrillated polypropylene ribbons supplied by Hercules Co., as in Example 9, having the same fibril denier.

EXAMPLE 11

Tan colored 2100 denier, 1.5 Z TPI heavily fibrillated by pin roll according to Example A, polypropylene ribbons, fibril denier, by Vibroscope measurement of 50 randomly selected fibrils, ranging from about 4 to about 31, with an average denier of 22.99.

EXAMPLE 12

Natural color 2400 denier, coarsely fibrillated polypropylene ribbon (determined by visual inspection), supplied from a private source, fibril denier and method of fibrillation unknown.

EXAMPLE 13

Tan colored 2.25$^s$/1 spun polyester, twisted 3.5 Z TPI yarns supplied by the Whitaker Company.

After weaving, the fabrics were subjected to aftertreatment to raise the fibrils above the plane of the fabric to the procedure of Example 7. The textiles were then laminated to a soft carpet and evaluated respecting adhesion. The results are reported in Tabble IV below. A 13 × 10 jute fabric was evaluated for comparison purposes.

TABLE IV

| Example No. | Weave Construction (actual ends per inch) Warp | × | Fill | Delamination Strength (lbs./3" strip-average of 3 tests) |
|---|---|---|---|---|
| 10 | 14.5 | × | 9.5 | 10 |
| 11 | 15.0 | × | 9.5 | 8.0 |
| 12 | 15.0 | × | 9.0 | 4.7 |
| 13 | 15.0 | × | 9.0 | 14.8 |
| Jute fabric | 13.0 | × | 10.0 | 15.9 |

It should be noted that while spun polyester fill provides excellent adhesion, the material is quite expensive, and unless more material is used, the fabric is likely to be sleazy i.e. have poor dimensional stability, thus adding to the already high cost.

Another advantage, apart from relative cost of materials that derives from the invention is that a manufacture can work solely with ribbons in both the warp and fill components. This means that he can extrude and slit film into ribbons. Some of the ribbons can be used as the warp members of a fabric useful as a secondary backing, while others of the ribbons can be fibrillated to provide the fill members. It is immediately appreciated that the present invention provides a substantial reduction in material and equipment inventory; with a fibrillator on the premises one need not inventory monofilaments, multifilament yarns or spun yarns. Further, one can disperse with spinnerets, dies and other apparatus that attends to the manufacture of these yarns.

EXAMPLE 14

A 15 × 9 (approximate) plain weave construction fabric was prepared from 1000 denier, beige polypropylene ribbon 75 to 100 mils wide in the warp and 1100 denier flat ribbon fill yarns, 100 mils wide. The woven fabric sample was then fibrillated after weaving by needling the entire surface and then napping prior to lamination to a soft carpet as with the fabric of Examples 10 through 13, and thereafter subjected to delamination testing as in those Examples, with the following results: Delamination Strength-lbs/3" strip-3.7 pounds.

EXAMPLE 15

This Example illustrates the relationship between the degree of fibrillation, adhesion and tensile strength. Several fabrics were prepared having an approximate 12 × 9 construction; the warp members were polypropylene ribbons as in the previous Examples and the fill members were fibrillated polypropylene ribbons. The degree of fibrillation is reflected in Table V below by the denier of the fibrils—the finer the fibril (lower the denier) the greater the degree of fibrillation. The denier was determined in this Example using a Goko Co. (Japan) Shadowgraph with a 10 power graduated width gauge lens. Specimens were mounted and viewed on smooth surfaced circular steel rods. Observations of fibril lengths and thicknesses and denier computations were made and reported in sets of 10 and 30 fibrils.

Following weaving each fabric was aftertreated by needling using a 15 × 18 × 32 × 3.5 gauge PB-30 (pinched barb) needles from the Foster Needle Co., of Manitowoc, Wisconsin. The fabric was run at a speed of 24 ft./min.; needle penetration depth was ⅜ to 7/16 inches at a needle speed of 700 stokes per minute and a needle penetration rate or density of 265 penetrations per square inch.

TABLE V

| SAMPLE | A | | B | | C | | D | | E | | F | |
|---|---|---|---|---|---|---|---|---|---|---|---|---|
| | (EXAMPLE 15) | | | | | | | | | | | |
| Delamination Str. (lb/3") | 7.5 | | 8.1 | | 9.8 | | 9.4 | | 11.1 | | 11.3 | |
| Grab Strength lb-bk | Fill 45 | Warp 57 | Fill 48 | Warp 58 | Fill 50 | Warp 55 | Fill 50 | Warp 56 | Fill 47 | Warp 56 | Fill 63 | Warp 56 |
| | FIBRIL DENIER (Shadowgraph) | | | | | | | | | | | |
| Average (range) | | | | | | | | | | | | |
| 10 Obser. | 122 (31–161) | | 146 (34–250) | | 87 (34–166) | | 66 (43–146) | | 44 (12–101) | | 74 (12–135) | |
| 30 Obser. | 101 (19–203) | | 122 (31–250) | | 81 (29–166) | | 58 (6–146) | | 50 (6–135) | | 68 (11–146) | |

It can be seen that, in general, a fibril denier becomes higher (i.e., coarser) adhesion decreases. It is further seen that fibrillated ribbons having individual fibrils up to 250 denier and average deniers as high as 122 can provide secondary backings having delamination strengths in excess of 7.5 pounds.

EXAMPLE 16

In this Example several fabrics were evaluated for use as secondary backing wherein one of the members was composed of polypropylene having a fire retardant additive. The fabrics were all approximate 12 × 9 constructions, the warp members being white colored 1000 denier polypropylene ribbon having incorporated therein the flame retardant additive. These members were from about 70 to 85 mils wide and from about 2.0–3.0 mils thick. The flame retardant material was a halogenated antimony oxide additive supplied in concentrate form from the Monmouth Plastic Company, under their proprietary designation PP 3. The material was mixed with the polypropylene resin in a blend, or let down ratio of 8 to 10:1 polypropylene to retardant. The fill members were white colored, heavily fibrillated ribbon prepared by the method described in Example A above. The fabrics were aftertreated by needling and brushing and delamination and grab strength tests were prepared. The results on three fabric samples, designated A, B and C together with an unneedled sample run as control are given below in Table VI.

TABLE VI

| FABRIC SAMPLE | (EXAMPLE 16) A | | B | | C | | Control | |
|---|---|---|---|---|---|---|---|---|
| Delamination Str. (lb/3") | 14.3 | | 14.0 | | 11.5 | | — | |
| Grab Strength lb-bk | Fill 41 | Warp 61 | Fill 30 | Warp 65 | Fill 40 | Warp 57 | Fill 113 | Warp 58 |
| Warp Yarn Width | 83 | | 80 | | 76 | | 81 | |
| Thickness | 2.6 | | 2.4 | | 2.7 | | 2.6 | |

EXAMPLE 17

In this Example, two fabrics were prepared A and B, in which heavily fibrillated polypropylene ribbons according to Example A, and Fibrillated Ribbon No. 1 of Example 1 was used as the warp members. The fabrics were approximate 9 × 13 constructions. The fill members were polypropylene unfibrillated 1000 denier ribbons, 65 to 70 mils wide and 1.5–2.0 mils thick. The fabrics were aftertreated by needling and brushing prior to lamination to a soft tufted carpet. In one fabric, designate Sample A, the fibrillated ribbon was twisted prior to weaving and in another, Sample B, the fibrillated member was untwisted. Delamination and Grab Strength tests were performed, the results are presented below in Table VII. The amount of twist as also given where applicable (Table VII).

TABLE VII

| SAMPLE | (EXAMPLE 17) Delamination Str. (lbs/3") | Grab Strength lbs.-bk Fill | Grab Strength lbs.-bk Warp | Yarn Twist (Z TPI) |
|---|---|---|---|---|
| A | 16.5 | 71.4 | 46.3 | None |
| B | 13.0 | 64 | 60.1 | 0.8 to 1.0 Z TPI |

From this Example it is seen that an acceptable secondary backing can be prepared wherein the warp member is the heavily fibrillated member. Further, the fibrillated material when slightly twisted provides a slight decrease in delamination strength.

EXAMPLE 18

This Example illustrates the proposition that a variety of fibrillation techniques are available to provide heavily fibrillated synthetic ribbons that, when woven into fabrics, display delamination strengths in excess of 7.5 pounds.

A fabric was woven with polypropylene ribbon as the warp members as in the previous Examples, and heavily fibrillated polypropylene ribbons as the fill members was prepared as in Example A except the ribbons were run over a roll with 34 hacksaw blades mounted around its periphery. Each blade had 24 fibrillating teeth per inch and the roll to film speed ratio was 2.05:1. The fabric had an approximate 12 × 9 construction and was laminated to a soft tufted carpet. Delamination and Grab Strength tests were performed (the latter on fill member only) with the following results:

| | |
|---|---|
| Delamination Strength: (lb/3") | 10.9 pounds |
| Grab Strength lb-bk | Fill 45.0 |

EXAMPLE 19

This Example illustrates another after treatment technique which can be used to provide secondary backings having delamination strength in excess of 7.5 pounds.

A fabric, approximate 12 × 9 construction, woven of unfibrillated, 1000 denier, polypropylene ribbons, 65 mils wide by 1.5 mils thick as the warp members and heavily fibrillated, untwisted 2400 denier ribbons as the fill members, was coated with a latex softener or sizing, in an amount of about 2% by weight of the fabric and heat treated in a tenter oven to dry the coating. The fabric was then aftertreated by a sueding or coat forming machine supplied by the Parks-Woolson Machine Co., Inc., of Springfield, Vermont, consisting of one or more rotating rolls covered with an abrasive such as emery cloth. The resulting fabric was then laminated to a soft carpet fabric and subjected to delamination and Grab Strength tests, with the following average results of 3 tests made:

| | |
|---|---|
| Delamination Strength: (lbs/3" strip) | 12.0 |
| Grab Strength (lbs-bk) | |
| Fill | 36 |
| Warp | 103 |

The fabric above describes and exemplified is a woven fabric of a synthetic polymer, preferably polyolefin, and most preferably polypropylene yarns which provides a synthetic substitute for jute fabrics. The fabrics of the invention have an appearance closely simulating jute fabric or burlap and a stikingly similar feel and hand. The fabrics possess the same hairy or fuzzy surface and display comparably acceptable adhesion qualities when laminated to a soft carpet. When used as backing in a carpet structure, the fabric gives added strength to the finished carpet and visually takes on the appearance of a jute backed fabric or carpet while retaining the advantages and attributes of the synthetic materials from which it is made.

The fabric of the invention also is useful for bags and sacks as a burlap replacement and overcomes the problems of previous synthetic yarn fabrics for this use in that the use of a fibrillated yarn in the warp or fill of the fabric induces high friction between them and the smoother ribbon yarns, thereby stabilizing the fabric such that it can easily contain heavy loads even of loose materials.

The fabric is characterized by having finely divided fibrils of low denier in the fill or warp yarns. It has been discovered that by fibrillation to produce fibrils having deniers in the ranges stated, fewer fibrils may be required in the fabric for adhesion strength, compared to prior art fabrics similar to those prepared and described in the above referenced patent to Eichoff et al. Prior art fabrics which are fibrillated after weaving as in Eichoff et al., are found to be unacceptable as secondary backings for carpet, in that when fibrillated severely enough for acceptable bond strengths, do not retain sufficient stability or fabric strength to be acceptable by the carpet industry. In contrast, the present invention gives the desired fibrous, fuzzy or hairy appearance, has acceptable adhesion qualities with high strength retention and good aesthetics; and some higher denier fibrils can be present and while still giving acceptable adhesion. The fabric adequately fulfills its roll as secondary backing and in addition it strengthens the finished carpet and gives it good dimensional stability and hand.

What is claimed is:

1. A woven polyolefin secondary backing comprising warp members and fill members, one of said warp and fill members comprising polyolefin ribbon from 0.5 to 4 mils thick, the other of said warp and fill members comprising heavily fibrillated polyolefin ribbon, the fibrils in said ribbon being from 3 to 235 denier and having an average denier of from about 12 to about 150, the backing characterized by a tensile strength greater than 30 pounds in the ribbon direction and greater than 25 pounds in the fibrillated ribbon direction and a delamination strength greater than 7.5 pounds.

2. A woven polypropylene secondary backing comprising polypropylene ribbon warp members that are from 0.5 to 4 mils thicks and heavily fibrillated polypropylene ribbon as the fill member, the fibrils in said fibrillated ribbon being from 3 to 235 denier, having an average denier of about 12 to about 150, the backing characterized by a tensile strength greater than 30 pounds in the warp direction, and greater than 25 pounds in the fill direction and a delamination strength greater than 7.5 pounds.

3. A woven polypropylene secondary carpet backing comprising ribbon polypropylene warp members from 0.5 to 4 mils thick, and from 75 to about 120 mils wide and heavily fibrillated polypropylene fill members whose fibrils are from 4 to 200 denier having an average denier of about 15 to about 100, said secondary backing characterized by a tensile strength greater than 30 pounds in the warp direction, and greater than 25 pounds in the fill direction and delamination strength greater than 7.5 pounds.

4. A synthetic woven fabric comprising warp members and fill members, at least one of which comprises heavily fibrillated synthetic ribbon, the fabric being characterized by a tensile strength greater than 25 pounds in the fibrillated ribbon direction and a delamination strength greater than 7.5 pounds when laminated to a soft carpet.

5. A fabric according to claim 4 in which one of the warp and fill member comprises heavily fibrillated synthetic ribbon and the other of the warp and fill members comprises unfibrillated or substantially unfibrillated synthetic ribbons.

6. A fabric according to claim 5 in which the unfibrillated or substantially unfibrillated ribbons are from 0.5 to 4 mils thick and from 30 to 200 mils wide.

7. A fabric according to claim 5 in which the unfibrillated or substantially unfibrillated ribbons are from 1.0 to 3 mils thick and from 50 to 100 mils wide.

8. A fabric according to claim 5 in which the unfibrillated or substantially unfibrillated ribbons are from 1.0 to 3 mils thick and from 50 to 100 mils wide.

9. A fabric according to claim 4 in which both the warp and the fill members comprise heavily fibrillated synthetic ribbon.

10. A fabric according to claim 4 in which the fibrils of the heavily fibrillated synthetic ribbon are from 3 to 235 denier and have an average denier from about 12 to about 150.

11. A fabric according to claim 10 in which a majority of the fibrils are less than 60 denier.

12. A fabric according to claim 4 in which the fibrils of the heavily fibrillated synthetic ribbon are from 4 to 200 denier and have an average denier from about 12 to about 125.

13. A fabric according to claim 4 in which the fibrils of the heavily fibrillated synthetic ribbon have an average denier of from 15 to 100.

14. A fabric according to claim 4 in which the warp and fill members each independently is polyamide, polyester, polyolefin or mixture thereof.

15. A fabric according to claim 4 in which the warp and fill members each is polyolefin.

16. A fabric according to claim 4 in which the warp and fill members are both polypropylene.

17. A fabric according to claim 4 in which the warp comprises unfibrillated or substantially unfibrillated synthetic ribbon from 0.5 to 4 mils thick and the fill comprises heavily fibrillated synthetic ribbon having fibrils from 4 to 200 denier and an average denier from 12 to 150.

18. A fabric according to claim 4 in which the warp comprises ribbons of polyamide, polyester, polyolefin or mixtures thereof, the warp ribbons being from 0.5 to 4 mils thick and from 30 to 200 mils wide and the fill comprises heavily fibrillated ribbons of polyamide, polyester, polyolefin or mixtures thereof, having fibrils from 4 to 200 denier and having an average denier of 15 to 100, the fabric further characterized by a tensile strength greater than 30 pounds in the warp direction and greater than 25 pounds in the fill direction.

19. A synthetic woven fabric comprising warp members and fill members, at least one of which comprises heavily fibrillated synthetic ribbon, the fabric being characterized by a tensile strength greater than 25 pounds in the fibrillated ribbon direction and having been processed to raise fibril ends above the plane of the fabric.

20. A fabric according to claim 19 in which one of the warp and fill members comprises synthetic ribbon from 0.5 to 4 mils thick and from 30 to 120 mils wide and the other of the warp and fill members comprises heavily fibrillated synthetic ribbon, having from 3 to 235 denier and an average denier from about 12 to about 150, the facric characterized by a tensile strength greater than 25 pounds in the fibrillated ribbon direction and a tensile strength greater than 30 pounds in the other direction and having been processed to raise fibril ends above the plane of the fabric.

21. A fabric according to claim 20 in which the warp member comprises unfibrillated or substantially unfibrillated ribbon and the fill member comprises heavily fibrillated ribbon.

22. A fabric according to claim 19 in which the heavily fibrillated ribbon is polypropylene.

23. A synthetic woven secondary carpet backing comprising warp and fill members at least one of said members comprising heavily fibrillated ribbons of polyolefin, polyamide, polyester or mixture thereof having fibrils from 3 to 235 denier and an average denier from about 12 to about 150 the backing characterized by a tensile strength greater than 25 pounds in the fibrillated ribbon direction and a delamination strength greater than 7.5 pounds when adhered to a soft carpet.

24. A secondary carpet backing according to claim 23 in which both warp and fill members comprise heavily fibrillated ribbons.

25. A secondary carpet backing according to claim 23 in which one of the warp and fill members comprises an unfibrillated or substantially unfibrillated ribbon of polyolefin, polyamide, polyester or mixture thereof from 0.5 to 4 mils thick and 30 to 200 mils wide.

26. A secondary carpet backing according to claim 25 in which the warp comprises unfibrillated or substantially unfibrillated ribbon and the fill comprises heavily fibrillated ribbon.

27. A secondary carpet backing according to claim 26 in which the warp comprises ribbons of polyolefin that are 1.0 to 3 mils thick and 50 to 150 mils wide and the fill comprises heavily fibrillated polyolefin ribbons having fibrils from 3 to 235 denier and an average denier of about 12 to about 150, the backing characterized by a tensile strength greater than 30 pounds in the warp direction and greater than 25 pounds in the fill direction and a delamination strength greater than 7.5 pounds when adhered to a soft carpet.

28. A secondary carpet backing according to claim 27 in which the warp comprises ribbons of polypropylene that are 1.5 to 3 mils thick and 60 to 100 mils wide and the fill comprises heavily fibrillated ribbons of polypropylene having fibrils from 4 to 200 denier and an average denier of about 15 to 100 said backing characterized by a tensile strength greater than 30 pounds in the warp direction and greater than 25 pounds in the fill direction and a delamination strength greater than 7.5 pounds when adhered to a soft carpet.

29. A secondary carpet backing according to claim 28 having from 10 to 30 ribbon ends per inch in the warp and from about 6 to about 12 fill picks per inch.

30. A carpet structure comprising (a) a primary backing containing a face pile attached thereto and (b) a secondary backing adhered to the underside of said primary backing and comprising synthetic warp members and fill members woven into a fabric, at least one of said warp and fill members comprising heavily fibrillated synthetic ribbon, the secondary backing characterized by a tensile strength greater than 25 pounds in the fibrillated ribbon direction and a delamination strength greater than 7.5 pounds.

31. A carpet structure according to claim 30 in which the warp and fill is each independently polyolefin, polyamide, polyester or mixture thereof and the heavily fibrillated ribbon has fibrils from 3 to 235 denier and an average denier from about 12 to about 150.

32. A carpet structure according to claim 31 in which both warp and fill members comprise heavily fibrillated ribbons.

33. A carpet structure according to claim 31 in which one of the warp and fill members comprises unfibrillated or substantially unfibrillated ribbon of polyolefin, polyamide, polyester or mixture thereof from 0.5 to 4 mils thick and 30 to 200 mils wide.

34. A carpet structure according to claim 33 in which the warp comprises unfibrillated or substantially unfibrillated ribbons of polyolefin 1.0 to 3 mils thick and 50 to 150 mils wide and the fill comprises heavily fibrillated polyolefin ribbons having fibrils from 4 to 200 denier and an average denier of about 15 to 100.

35. A carpet structure according to claim 30 having from 10 to 30 ribbon ends per inch in the warp and from about 6 to about 12 fill picks per inch.

36. A carpet structure according to claim 30 in which the adhesive is rubber latex or hot melt adhesive.

37. A method of aftertreating woven textile and textile being woven of polyolefin ribbon warp members and heavily fibrillated fill members to raise the fibril ends of said fibrillated members above the surface of the textile which comprises needling said textile by barbed needles, said needles being reciprocated from about 350 to 800 strokes per minute to penetrate said textile at a depth of $\frac{5}{8}$ inches to about 15/32 inch and from about 100 to about 300 penetrations per square inch of textile.

38. A method of aftertreating a textile according to claim 37 in which the warp and fill members are polypropylene.

39. A method of aftertreating a woven textile according to claim 37 in which the needles are reciprocated in a needleboard.

40. A method of aftertreating a woven textile according to claim 39 in which the needles are arranged in rows in the needleboard with the barbs parallel to the unfibrillated members.

41. A method of aftertreating a woven textile according to claim 37 in which the needles have a pair of barbs 180° opposed on their shanks.

42. A method of making a synthetic secondary carpet backing which comprises processing a fabric woven of synthetic warp and fill members, wherein at least one of the warp and fill members comprises heavily fibrillated synthetic ribbon, to raise fibril ends above the plane of the fabric, the resulting secondary carpet backing characterized by a tensile strength in the fibrillated ribbon direction greater than 25 pounds and a delamination strength greater than 7.5 pounds when laminated to a soft carpet.

43. A method according to claim 42 in which the processing comprises brushing, penetration by barbed needles, abrasion or combination thereof.

44. A method according to claim 43 in which the processing comprises brushing with a clothing napper.

45. A method according to claim 43 in which the processing comprises penetration by barbed needles of substantially only the fibrillated member.

46. A method according to claim 45 in which the needles have a pair of rows of barbs, 180° opposed on the shank.

47. A method according to claim 46 in which each row has two barbs, each barb in one row being displaced from a corresponding barb in the other row.

48. A method according to claim 47 in which the needles are pinched barb 15 × 18 × 32 × 3.0 or 3.5 gauge.

49. A method according to claim 43 in which the needles are reciprocated and penetrate the fabric to a depth of from $\frac{5}{8}$ to about 15/32 inches.

50. A method according to claim 43 in which the needles are reciprocated from about 350 to about 800 strokes per minute and penetrate the fabric from about 100 to 300 penetrations per square inch of fabric.

51. A method according to claim 50 in which the fabric moves through the zone of reciprocating needles at from about 20 to about 40 feet per minute.

52. A method according to claim 50 in which the needles are arranged in rows in a reciprocating needleboard with the backs of the needles perpendicular to the fibrillated member.

* * * * *